US006244077B1

(12) United States Patent
Offermann et al.

(10) Patent No.: US 6,244,077 B1
(45) Date of Patent: Jun. 12, 2001

(54) MULTILAYER KNITTED STRUCTURE AND METHOD OF PRODUCING THE SAME

(75) Inventors: Peter Offermann; Gerald Hoffmann, both of Dresden; Uwe Engelmann, Guben, all of (DE)

(73) Assignee: Technische Universitaet Dresden, Dresden (DE)

( * ) Notice: Subject to any disclaimer, the term of this patent is extended or adjusted under 35 U.S.C. 154(b) by 0 days.

(21) Appl. No.: 09/077,135

(22) PCT Filed: Dec. 12, 1995

(86) PCT No.: PCT/DE95/01774

§ 371 Date: Jul. 13, 1998

§ 102(e) Date: Jul. 13, 1998

(87) PCT Pub. No.: WO97/21860

PCT Pub. Date: Jun. 19, 1997

(51) Int. Cl.[7] ..... D04B 7/12
(52) U.S. Cl. ..... 66/195; 66/190; 139/383 R
(58) Field of Search ..... 139/383 R, 11; 66/190, 196, 195, 192

(56) References Cited

U.S. PATENT DOCUMENTS

| | | | | |
|---|---|---|---|---|
| 393,185 | * | 11/1888 | Stowe | 66/196 |
| 628,818 | * | 7/1899 | Koch | 66/196 |
| 3,859,824 | * | 1/1975 | Krylov et al. | 66/10 |
| 4,787,219 | * | 11/1988 | Sato et al. | 66/196 |
| 5,191,777 | * | 3/1993 | Schnegg | 66/195 |

* cited by examiner

*Primary Examiner*—John J. Calvert
*Assistant Examiner*—Robert H. Muromoto, Jr.
(74) *Attorney, Agent, or Firm*—Jordan and Hamburg LLP

(57) ABSTRACT

A multilayer knitted structure includes two knitted webs which are interconnected by a third thread system. The two knitted webs are held together by at least one bundle of warp threads, and is suited for use in producing semi-finished structures for fiber composites. The thickness of the multilayer knitted structure can be increased by further warp thread bundles and additional weft threads. The warp and weft threads are advantageously configured to run according to the stress applied, for example, in the fiber composite.

18 Claims, 5 Drawing Sheets

MULTILAYER KNITTED STRUCTURE AND METHOD OF PRODUCING THE SAME

The invention concerns a multilayer flat or circular knitted structure comprising two plain knitted webs which are interconnected by a third thread system. The invention also concerns a method of producing the same, especially of producing semi-finished structures for fibre composites.

By DE-PS 458 906 there is known a multilayer knitted structure comprising two plain knitted webs, their fabric backs facing each other and being interconnected by a third thread system. In this knitted structure the third thread system consists of a bundle of standing threads by which the coherence of the outer knitted webs is ensured. The knitwear has the function of connecting two different product surfaces. The third thread system is intended to stuff the knitted structure better and to provide strength in the longitudinal direction.

According to DE 29 27 414 A1 a reinforcing knitted structure for resinous laminates is known which consists of a warp-knitted fabric or a knitted structure with reinforcing interlining. The reinforcing knitted structure consists of a large number of parallel warp interlining layers and a large number of parallel weft interlining layers in the knitwear. The warp interlining is limited by the bottom half arcs, and the weft interlining is limited by the plain stitches. A disadvantage is the construction which is connected to a specific sequence. Moreover, a reinforcing textile with reinforcing threads adapted to stress cannot be produced or can be produced only conditionally.

It is also known to produce two separate knitted webs on knitting machines at the same time parallel to each other by means of two needle beds. By interconnecting in places also three-dimensional knitted structures can be made. The knitted webs can be connected by a third knitted web according to DE 40 08 057 A1. According to DE 36 43 357 A1 the connection is made by at least one knitted-in or inwrought, comparatively thin, separate intermediate thread or a knitted structure. With this kind of connection of two halves of knitted structure the coherence is established by the formation of loops. The binding thread itself forms stitches or loops. The knitted structures therefore do not have stretched thread layers and are only conditionally suitable as reinforcing knitted structure.

It is the object of the invention to produce a multilayer knitted structure of the above-mentioned kind which can be designed thin-walled as well as thick-walled, has a high drapability and is capable of absorbing tensile, compressive and bending forces.

In accordance with the invention the problem is solved by the means mentioned in the claims and explained in detail by the embodiments.

Layers of warp threads and weft threads are inserted into the plain knitted structures limiting the outer sides. The coherence of the warp-thread and weft-thread layers is ensured by the back foots which pass the layers and loop all present warp threads. The multilayer knitted structure is held together by warp threads looped by bottom half arcs alone or together with weft threads which are covered with plain stitches, depending on the structure of the warp-thread and weft-thread layers.

Warp and weft threads follow the transfer of forces in the fibre composite in an advantageous way.

The density of the warp threads or/and weft threads need not necessarily be equidistributed over the width and length of the knitted web; it may be locally zero, for instance, for the reception of parts such as screws.

Changing of the warp threads into other planes formed by the weft threads is furthermore possible, and vice versa. In this way, transfer tails are created, which prove to be advantageous in a later shaping-out of the reinforcing textile.

By the stretched layers of warp and weft threads the forces are absorbed in the fibre composite. The coherence of the layers over the two knitting-thread systems guarantees a high drapability of the knitted structure and a good delamination behaviour if the knitting thread consists of high-performance material.

Of course, the multilayer knitted structure is suitable for the production of other fabrics, besides the production of fibre composites, e. g. for the production of surfaces with fabric and insulation properties.

With the process according to the invention a knitting thread is crosswise fed to at least one bundle of warp threads from two sides, e. g. from two needle beds. By means of needles the knitting thread is pulled through in loops and interlooped with the preceding knitting thread of the same knitting-thread system on the other side. Subsequently, on the other side (opposite the side of the first knitting thread) a second knitting thread is crosswise fed and processed in the same way as the first knitting thread.

To increase the thickness of the knitted structure, several bundles of warp threads are fed between the two knitted webs. A limitation is given by the design, e. g. the needle size. Besides the feeding of warp threads or bundles of warp threads, between the knitting of the individual courses there can be laid single weft threads between the warp-thread bundles or at their sides.

Warp and weft threads may be carried almost unlimitedly in any direction and change into other planes. The direction is determined mainly by the transfer of forces in the fibre composite or by spots with special reinforcement.

The advantage of the invention is that a large number of warp and weft threads are interconnected by two knitting threads. Therefore, the knitted structure is very drapable, the interconnection of the layers being ensured. The knitted structure is thus especially suitable for the production of fibre composites.

The invention will now be explained in greater detail with reference to embodiments thereof. In the drawings there are shown by FIG. 1 a representation for illustrating the method with warp thread and two needles FIG. 2 a cross-section of a multilayer knitted structure with 2 layers of warp threads and 3 layers of weft threads FIG. 3 a top view of a multilayer knitted structure with a stretched warp-thread layer FIG. 4 a top view of a multilayer knitted structure with an empty space made by racking of the warp threads FIG. 5 a top view according to FIG. 4 with an additional layer of stretched weft threads and different density of weft threads FIG. 6 a top view according to FIG. 4 with weft threads carried around the empty space FIG. 7 a representation for illustrating the method with 2 warp threads and 3 weft threads FIG. 8 a representation with variable design of the weft-thread layers In FIG. 1 the method with warp thread and two needles is represented with its two, temporally staggered partial cycles. In the first partial cycle the needles 1*a* of the front needle bed 2*a*, in the second partial cycle the needles 1*b* of the rear needle bed 2*b* are moved in their longitudinal direction by means of cam assembly mechanisms, which are not represented here. The needle heads of each needle 1*a*, 1*b* alternately completely penetrate the warp-thread bundle 4 at the height of the warp guide tube 3. During the upward movement of the needle 1*a*, 1*b* the half stitch 5*a*, 6*a* gets onto the needle shaft, opening the needle latch. At the upper dead centre of the needle 1*a* of the front needle bed 2*a* the knitting thread 5 of one of the knitting-thread systems is laid into the opened needle head of the needle 1*a* and thus behind the warp-thread bundle 4. At the upper dead centre of the needle 1*b* of the rear needle bed 2*b* the knitting thread 6, which is not represented here, of the other knitting-thread system is laid into the opened needle head of the needle 1*a* and thus in front of the warp-thread bundle 4. During the return movement of the needle 1*a*, 1*b* the knitting thread 5, 6 is pulled in the form of loops between the warp threads of the warp-thread bundle 4, the half stitch 5*a*, 6*a* closing the needle latch, sliding over it and being cast off on the closed needle head on the respective other side of the warp-thread bundle 4.

FIG. 2 shows the cross-section of a multilayer knitted structure which can be produced according to the method disclosed by the invention. The individual layers are formed from weft threads 7*a*, 7*b*, 7*c* and warp threads 4*a*, 4*b*, their arrangement and order being freely selectable. In the example, the two knitting-thread systems are interconnected by two warp-thread bundles in that the back foots 5*a* of one knitting-thread system 5 are arranged in front of the front warp-thread bundle 4*a* and the back foots 6*a* of the other knitting-thread system 6 are arranged behind the rear warp-thread bundle 4*b*.

FIG. 3 shows a top view of a multilayer knitted structure with stretched warp-thread layer. In the figure only the upper warp-thread bundle is visible. Other bundles may be arranged behind it. It can be seen from the figure how the warp threads are looped by the bottom half arcs of the knitting threads.

In FIG. 4 a certain number of warp threads changes laterally out of the stretched thread layer and then returns into their original position. Thus an empty space of warp threads is obtained which is suitable for the reception of parts, e. g. screws. Here, the coherence is ensured by both knitting threads. Complete open-knit spots can be produced by transferring of the half stitches.

In FIG. 5 the knitted structure is reinforced by an additional layer of weft threads. In the example the weft threads are held by the warp threads and the plain heads of a knitted web. The spacing of the weft threads can be varied.

According to FIG. 6 the weft threads are carried around the empty space in FIG. 4. One of the weft threads is carried on in the original layering direction, the other in the opposite direction. The weft threads thus produce a reinforcement around the empty space. Such a solution is appropriate if this spot is subjected to a particularly high stress.

Figure 1:
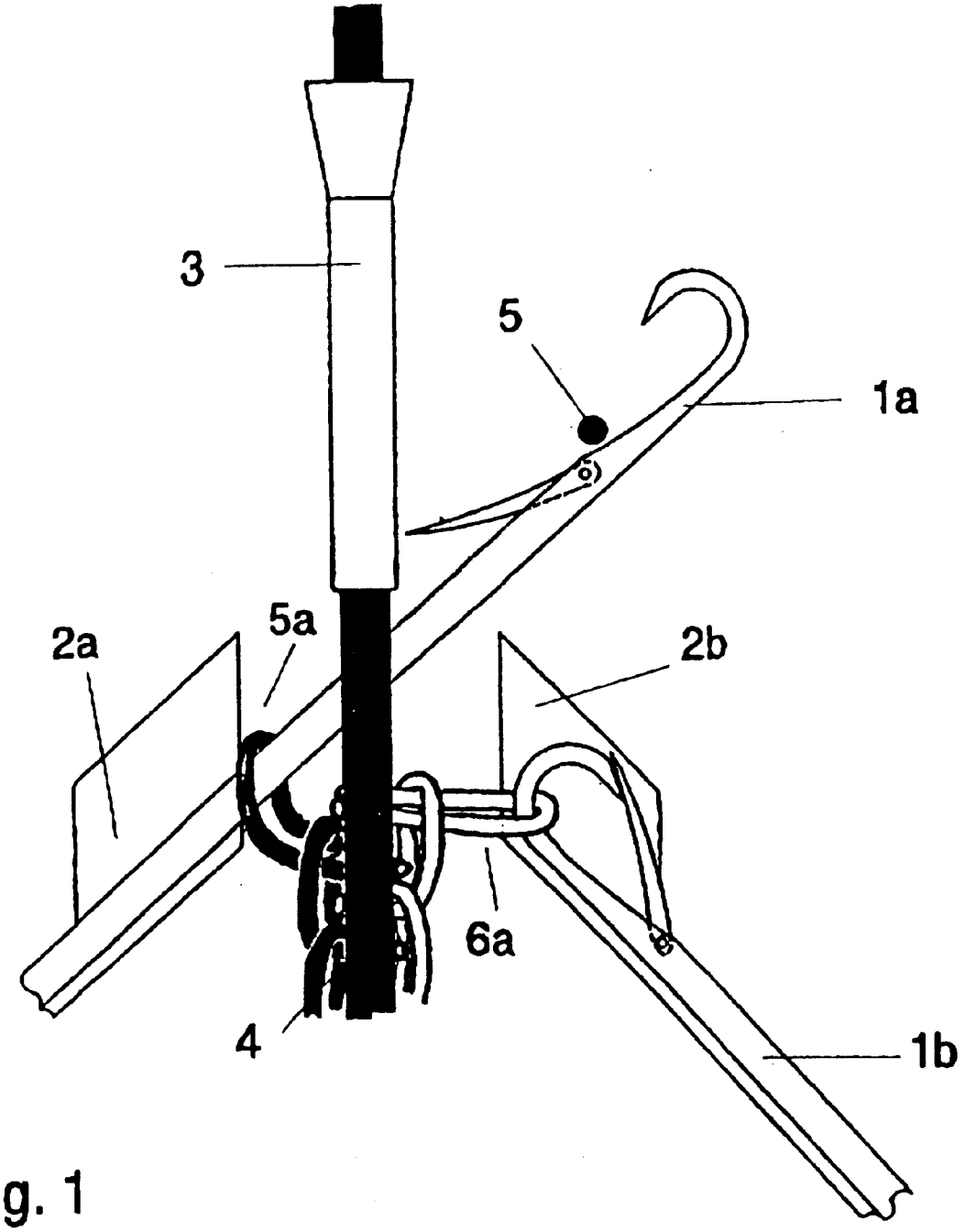
Figure 2:
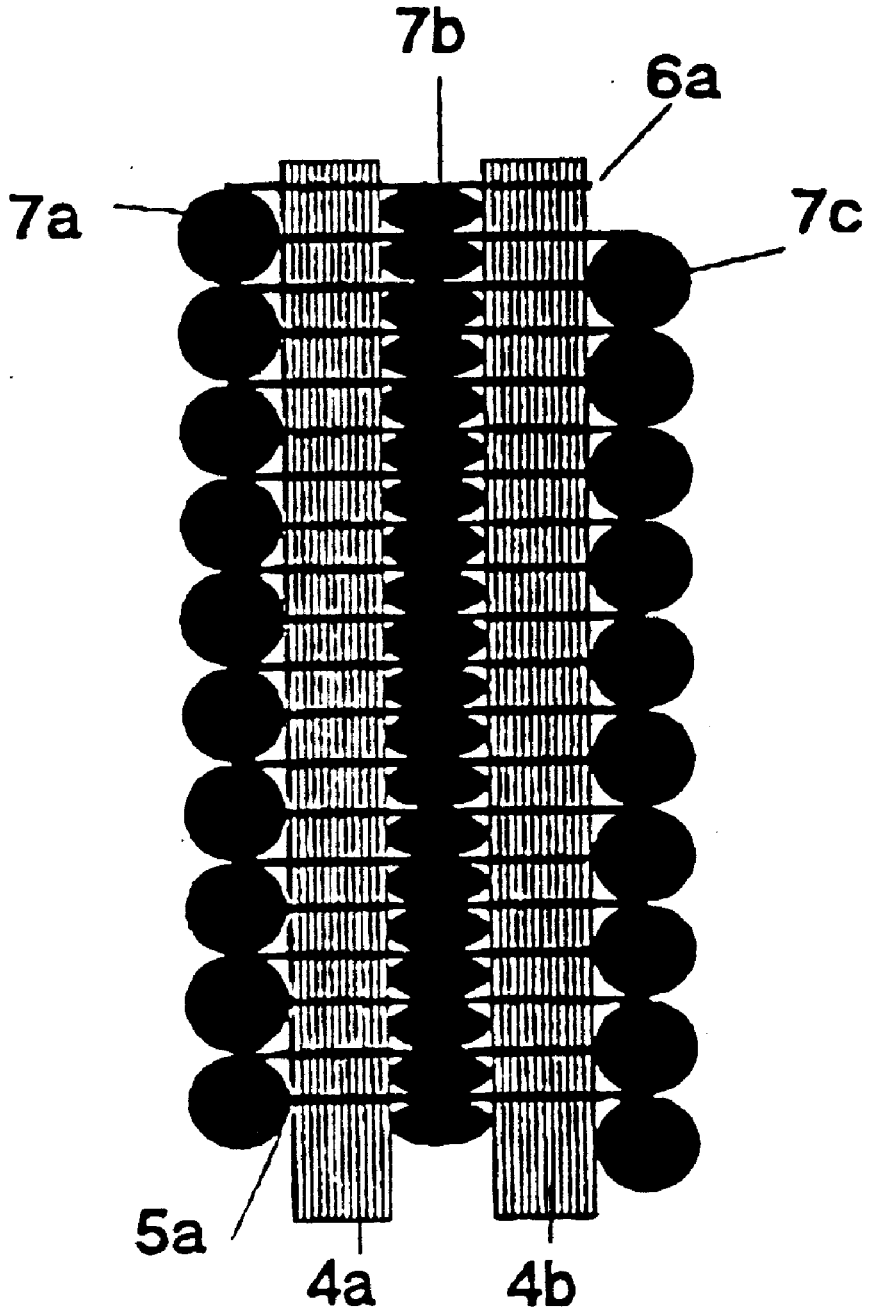
Figure 3:
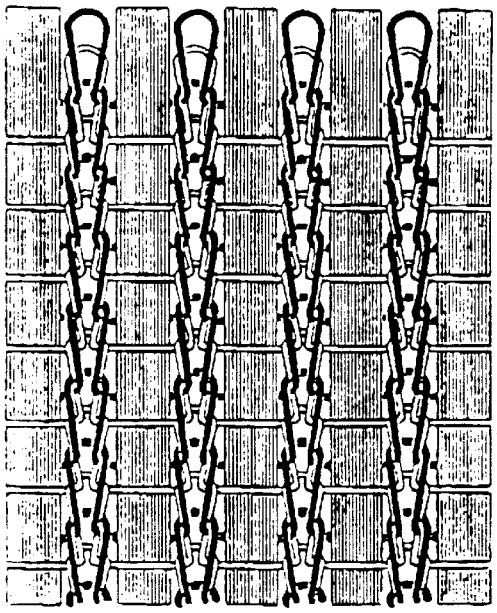
Figure 4:
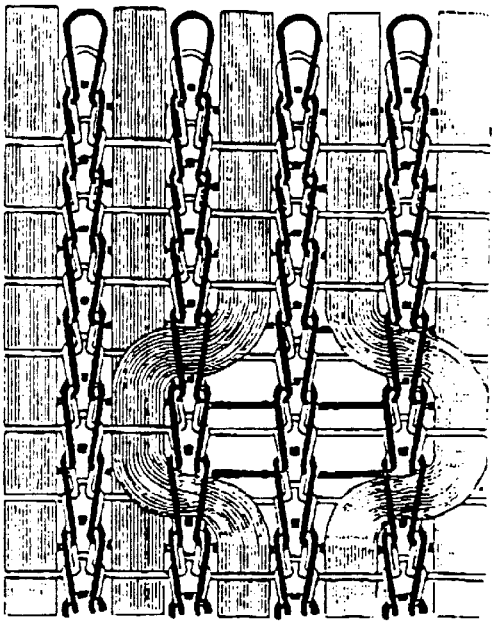
Figure 5:
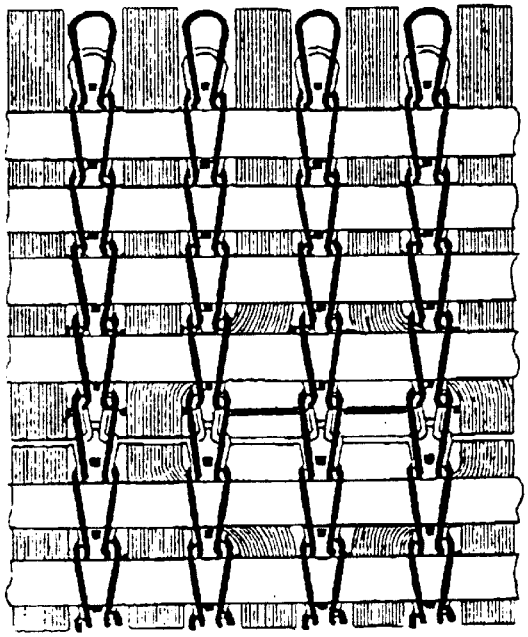
Figure 6:
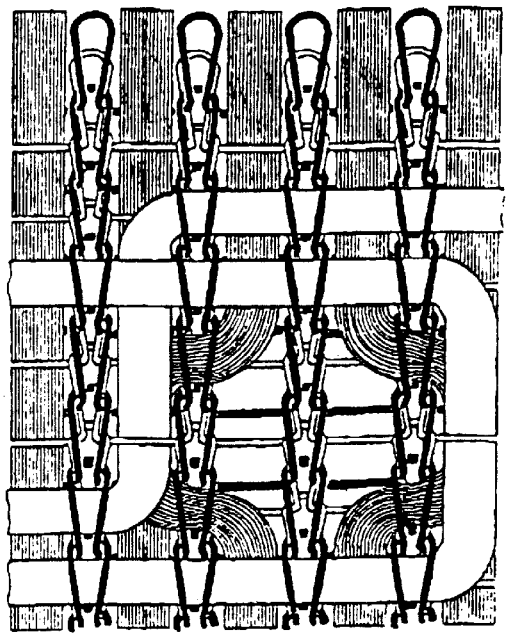
Figure 7:
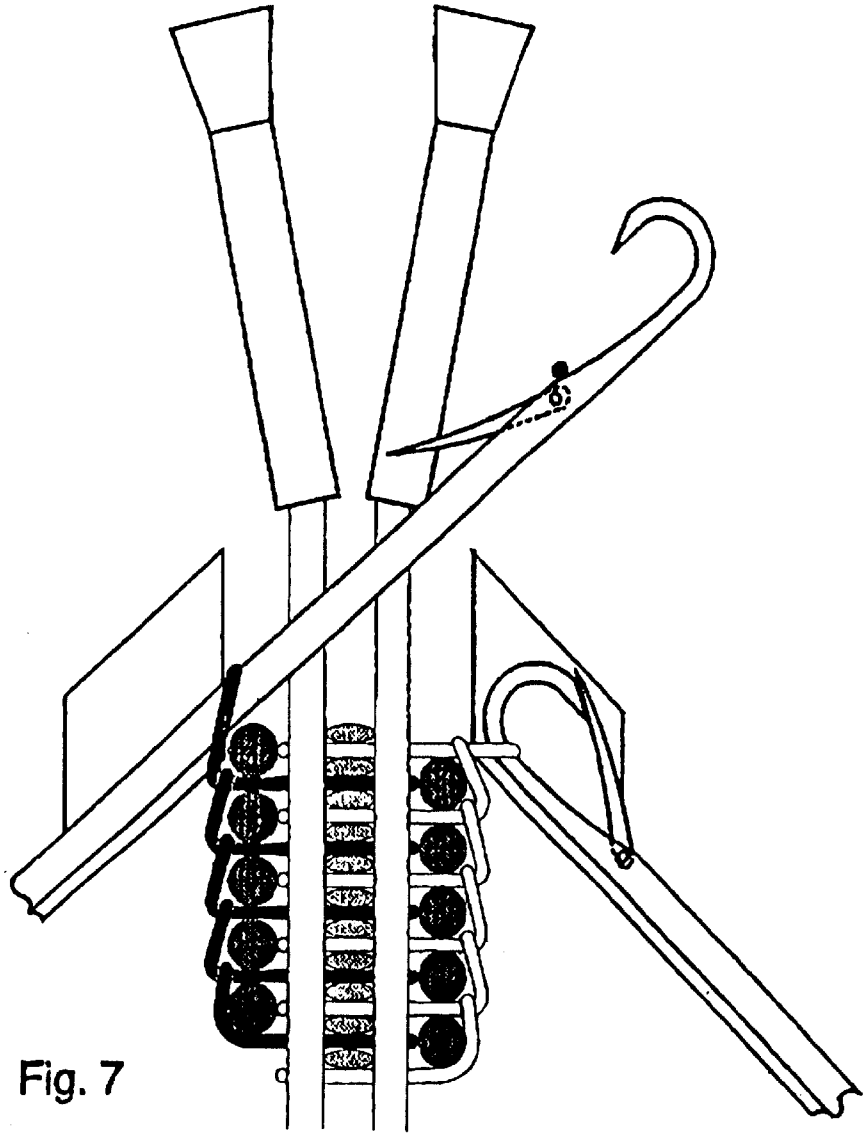
FIG. 7 is another representation for illustrating the method. It is represented how during the feeding of 2 bundles of warp threads and 3 layers of weft threads the two knitted structures and the warp- and weft-thread layers are interconnected.
Figure 8:
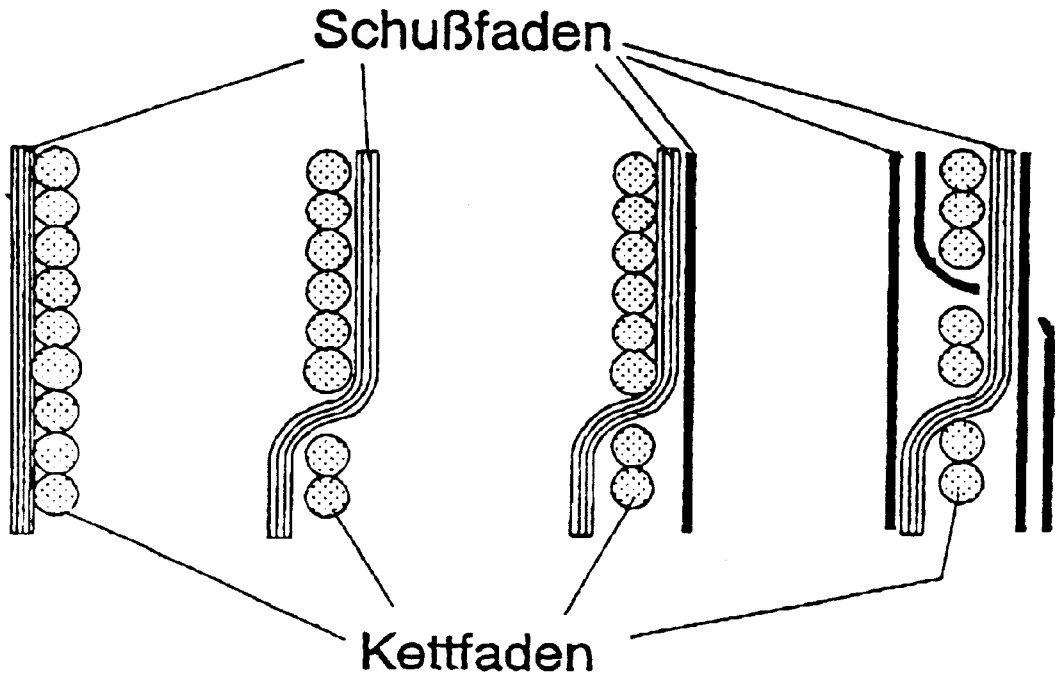
FIG. 8 shows possible flows of the weft-thread layers which are produced by changing between the planes determined by the warp-thread bundles. In analogy to that result the flows of the warp threads which are produced by changing between the planes determined by the weft-thread layers.

What is claimed is:

1. A multi-layer knitted fabric, comprising:

two right/left knitted widths, a left side of each facing one another; and a third thread system including at least two sheets of warp yarns, left-sided arcs of loops of respective ones of the right/left knitted widths passing through the at least two sheets of warp yarns such that the left-sided arcs extend beyond outermost warp yarns in a direction of an opposite one of said right/left knitted widths whereby said third thread system is tied into the two right/left knitted widths.

2. A multi-layer knitted fabric according to claim 1, further comprising at least one additional group of filling yarns tied into the two right/left knitted widths, the right-sided loops extending over outermost filling yarns such that at least one outer sheet of filling yarns is formed.

3. A multi-layer knitted fabric according to claim 1, wherein warp yarns from at least two warp yarn sheets of at least one left-sided arc pair including in each case one arc of the front knitted width and one arc of the rear knitted width are included.

4. A multi-layer knitted fabric according to claim 3, wherein the number of warp yarns per arc pair changes over the width of the knitted widths.

5. A multi-layer knitted fabric according to claim 3, wherein the number of warp yarns per arc pair changes over the width and length of the knitted widths.

6. A multi-layer knitted fabric according to claim 1, wherein the filling yarns are disposed between shanks of the loops of a knitted width and the warp yarn sheets.

7. A multi-layer knitted fabric according to claim 1, wherein the filling yarns are disposed between the warp yarn sheets.

8. A multi-layer knitted fabric according to claim 6, wherein the filling yarns sectionally are disposed parallel to the warp yarn sheets.

9. A multi-layer knitted fabric according to claim 6, wherein the number of filling yarns varies over the width of the knitted width.

10. A multi-layer knitted fabric according to claim 6, wherein the number of filling yarns varies over the width and length of the knitted width.

11. A multi-layer knitted fabric according to claim 3, wherein the density of the warp yarns measured by the number is locally zero.

12. A multi-layer knitted fabric according to claim 3, wherein the density of the filling yarns measured by the number is locally zero.

13. A method for producing a multi-layer knitted fabric, comprising:

supplying a third yarn system including at least two warp yarn sheets;

transversely placing rows of a first loop yarn on a front side of the third yarn system;

sequentially pulling a particular row of said first loop yarn through said third yard system in the form of loops to a rear side of the third yarn system;

interlooping said loops on the rear side of the third yarn system with a preceding transverse-placed row of said first loop yarn to form a first right/left knitted width;

transversely placing rows of a second loop yarn on the rear side of the third yarn system;

sequentially pulling a particular row of said second loop yarn through said third yard system in the form of loops to the front side of the third yarn system; and interlooping said loops on the front side of the third yarn system with a preceding transverse-placed row of said second loop yarn of to form a second right/left knitted width.

14. A method according to claim 13, wherein each of the warp yarn sheets is offset in a loop row direction.

15. A method according to claim 13, further comprising placing individual filling yarns one of between and to the side of the warp yarn sheets on last formed loops of the loop yarns in the row direction between the knitting of rows, next loops being formed over the filling yarns.

16. A method according to claim 15, wherein the laying of individual filling yarns at any position for the period of the knitting is interrupted by at least one row of loops, and after that, continued in any direction.

17. A method according to claim 3, wherein the warp yarn sheets are swiveled in planes determined by the filling yarns.

18. A method according to claim 3, wherein the filling yarns are guided between planes determined by the warp yarn sheets.

* * * * *